US007562644B2

(12) United States Patent
Kim

(10) Patent No.: US 7,562,644 B2
(45) Date of Patent: Jul. 21, 2009

(54) VARIABLE VALVE LIFT APPARATUS

(75) Inventor: Hyung Ick Kim, Gunpo (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/732,999

(22) Filed: Apr. 5, 2007

(65) Prior Publication Data

US 2008/0141958 A1 Jun. 19, 2008

(30) Foreign Application Priority Data

Dec. 14, 2006 (KR) ..... 10-2006-0128098

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.2, 90.39, 90.44, 90.6, 90.11; 74/559, 74/567, 569

See application file for complete search history.

(56) References Cited

U.S. PATENT DOCUMENTS 6,201,610 B1 * 3/2001 Ogino ..... 358/1.15
6,467,444 B2 * 10/2002 Tanaka et al. ..... 123/90.16

* cited by examiner

*Primary Examiner*—Ching Chang
(74) *Attorney, Agent, or Firm*—Morgan, Lewis & Bockius LLP

(57) ABSTRACT

A variable valve lift apparatus includes a cam, a camshaft that rotates the cam, at least one cam follower selectively connected to an end lever such that the cam follower opens and closes a valve corresponding to rotation of the cam, and a variable device selectively connecting the cam follower with the end lever to regulate whether or how much the valve is opened and closed. Three cam followers may be provided: two outer cam followers fixedly connected to the end lever, and an inner cam follower interposed between and selectively connected to the outer cam followers corresponding to an operation of the variable device. The variable device may include a first pin in one of the outer cam followers, a second pin in the inner cam follower, and a third pin in the other outer cam follower. The pins may be configured to move together.

1 Claim, 4 Drawing Sheets

VARIABLE VALVE LIFT APPARATUS

CROSS-REFERENCE TO RELATED APPLICATION

This application claims priority to and the benefit of Korean Patent Application No. 10-2006-0128098 filed in the Korean Intellectual Property Office on Dec. 14, 2006, the entire contents of which are incorporated herein by reference.

BACKGROUND OF THE INVENTION (a) Field of the Invention

The present invention relates to a variable valve lift apparatus.

(b) Description of the Related Art

Generally, a variable valve lift apparatus uses hydraulic pressure to control the opening/closing amount of a valve, or the valve operation or non-operation. More particularly, in a cylinder deactivation (CDA) system, the valve is operated or not operated by the variable valve lift apparatus, and in a variable valve lift (VVL) system, the opening/closing amount of the valve is regulated.

However, because the variable valve lift apparatus is operated by hydraulic pressure, the operating area is limited. If the engine is worn out, operating performance is deteriorated by changes in oil characteristics. In addition, the numerous hydraulic lines provide a complicated system, and necessitate additional monitoring sensors, such as a hydraulic pressure sensor and a fluid temperature sensor.

The above information disclosed in this Background section is only for enhancement of understanding of the background of the invention and therefore it may contain information that does not form the prior art that is already known in this country to a person of ordinary skill in the art.

SUMMARY OF THE INVENTION

A variable valve lift apparatus according to an exemplary embodiment of the present invention includes a cam, a camshaft that rotates the cam, at least one cam follower selectively connected to an end lever such that the cam follower opens and closes a valve corresponding to rotation of the cam, and a variable device selectively connecting the cam follower with the end lever to regulate whether or how much the valve is opened and closed. Three cam followers may be provided: two outer cam followers fixedly connected to the end lever, and an inner cam follower interposed between and selectively connected to the outer cam followers corresponding to an operation of the variable device.

The variable device may include a first pin in one of the outer cam followers, a second pin in the inner cam follower, and a third pin in the other outer cam follower. The pins may be configured to move together.

The variable device may also include an elastic member biasing the first pin toward the third pin, and a solenoid device operating such that the third pin moves toward the first pin.

The solenoid device may include a coil generating a magnetic force if current is applied thereto, an armature secured to the third pin such that the third pin moves toward the first pin when current is applied to the coil, and an actuator operating the coil.

DETAILED DESCRIPTION OF THE PREFERRED EMBODIMENTS

An exemplary embodiment of the present invention will hereinafter be described in detail with reference to the accompanying drawings.

Figure 1:
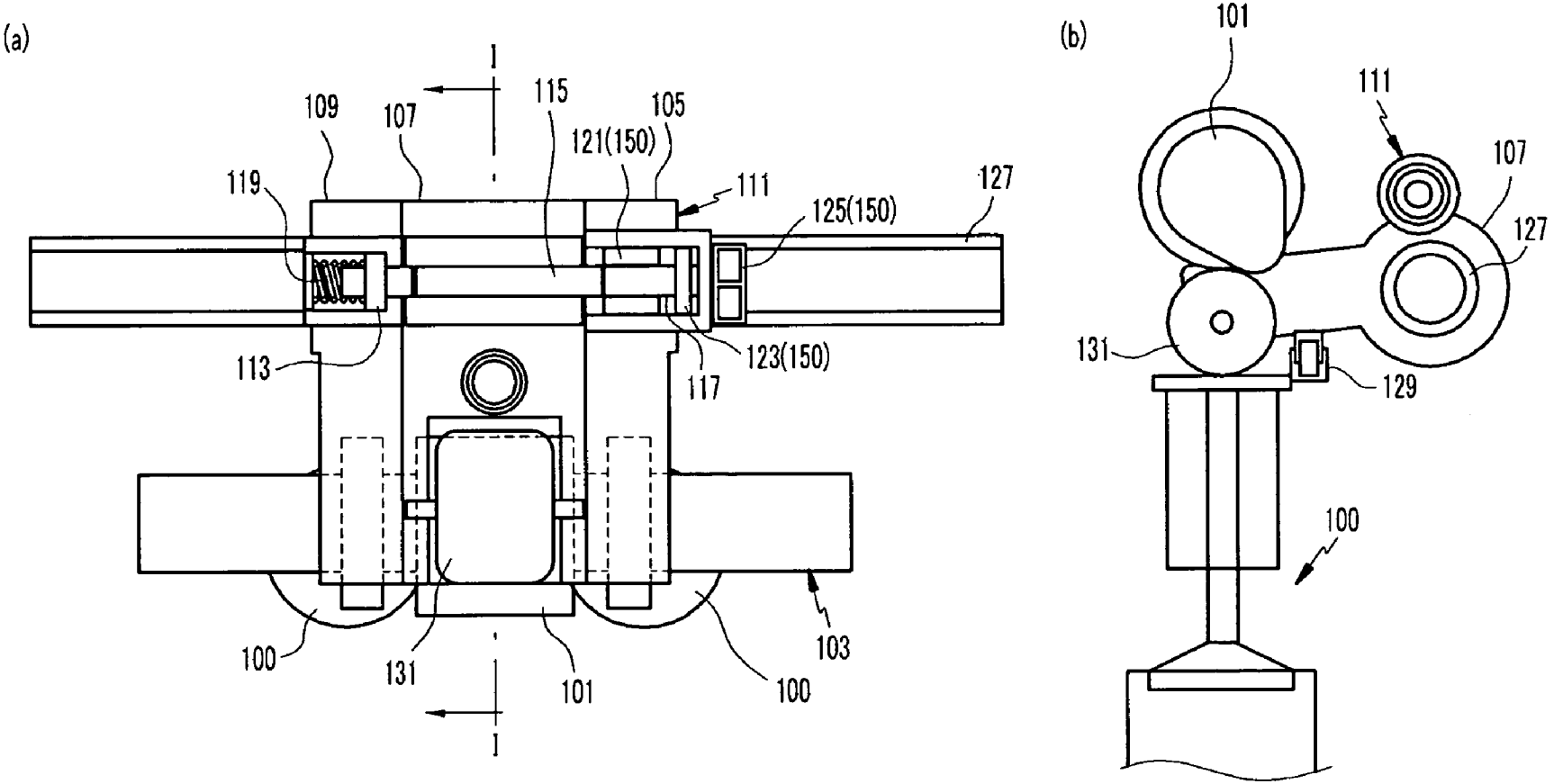
FIG. 1 shows a state in which a variable valve lift apparatus that is applied to a cylinder deactivation (CDA) system is off according to an exemplary embodiment of the present invention. More particularly, FIG. 1(*b*) is a sectional view along line I-I in FIG. 1(*a*).
Figure 2:
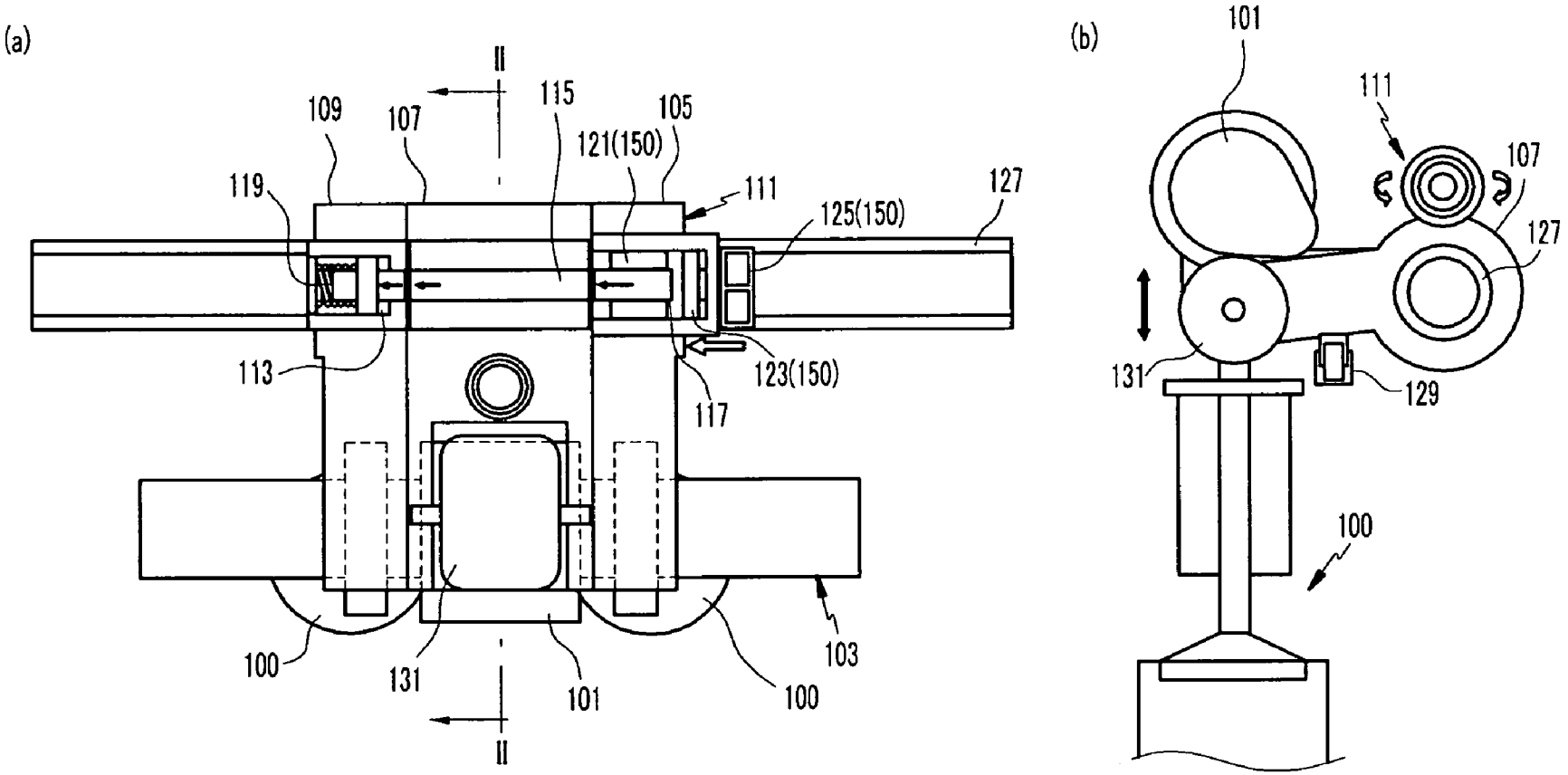
FIG. 2 shows a state in which a variable valve lift apparatus that is applied to a cylinder deactivation (CDA) system is on according to an exemplary embodiment of the present invention. More particularly, FIG. 2(*b*) is a sectional view along line II-II in FIG. 2(*a*).

Referring to FIG. 1 and FIG. 2, in a first exemplary embodiment of the present invention, a variable valve lift apparatus is applied to a cylinder deactivation (CDA) system. A CDA system selectively operates such that a valve disposed to a cylinder operates/does not operate.

The variable valve lift apparatus includes a cam 101, a camshaft 103, a variable device 111, outer cam followers 105 and 109, and an inner cam follower 107.

The cam 101 opens and closes a valve 100 by rotation of the camshaft 103 that is connected to the cam 101.

The variable device 111 selectively connects at least one of the cam followers 105, 107, and 109 with an end lever 127 such that the cam followers open and close the valve 100 corresponding to the rotation of the cam 101.

At least one of the outer cam followers 105, 109 is fixedly connected to the end lever 127, and the inner cam follower 107 is interposed between the outer cam followers 105 and 109 and selectively connected to the outer cam followers 105 and 109 corresponding to an operation of the variable device 111.

Therefore, when the cam 101 rotates, the cam followers 105, 107, and 109 move downward. The valve 100 is then opened by a needle bearing 131 that moves downward. If the cam 101 continues to rotate, the cam followers 105, 107, and 109 move back to their original positions by a lost motion spring 129.

The variable device 111 includes a first pin 113, located in the outer cam follower 109, a second pin 115, located in the inner cam follower 107, and a third pin 117, located in the outer cam follower 105. The pins 113, 115, and 117 move integrally.

The variable device 111 further includes an elastic member 119, disposed such that the first pin 113 moves toward the third pin 117, and a solenoid device 150, which operates such that the third pin 117 moves toward the first pin 113.

The variable device 111 is controlled by an engine control unit (ECU), which may include a processor, memory, and associated hardware, software, and/or firmware as may be selected and programmed by a person of ordinary skill in the art based on the teachings herein.

The solenoid device 150 includes a coil 121, which generates a magnetic force if current is applied thereto, and an armature 123, which is secured to the third pin 117 such that the third pin 117 moves toward the first pin 113 when current is applied to the coil 121. The solenoid device 150 further includes an actuator 125, which operates the coil 121.

That is, if current is applied to the coil 121, the armature 123 is connected to the coil 121 by the magnetic force of the coil 121. Therefore, the third pin 117 pushes the second pin 115, which, in turn, pushes the first pin 113. Resultantly, the connections between the cam followers 105, 107, and 109 are released such that each cam follower 105, 107, 109 can move independently.

Therefore, as shown in FIG. 1, when the variable device 111 does not operate, the cam followers 105, 107, and 109 move as a single unit, but when the variable device 111 operates, as shown in FIG. 2, the cam followers 105, 107, and 109 move independently.

Therefore, when the variable device 111 operates, if the cam 101 rotates, only the inner cam follower 107 moves downward and the outer cam followers 105 and 109 do not move. Resultantly, if the variable device 111 operates, the valve 100 is not opened.

Figure 3:
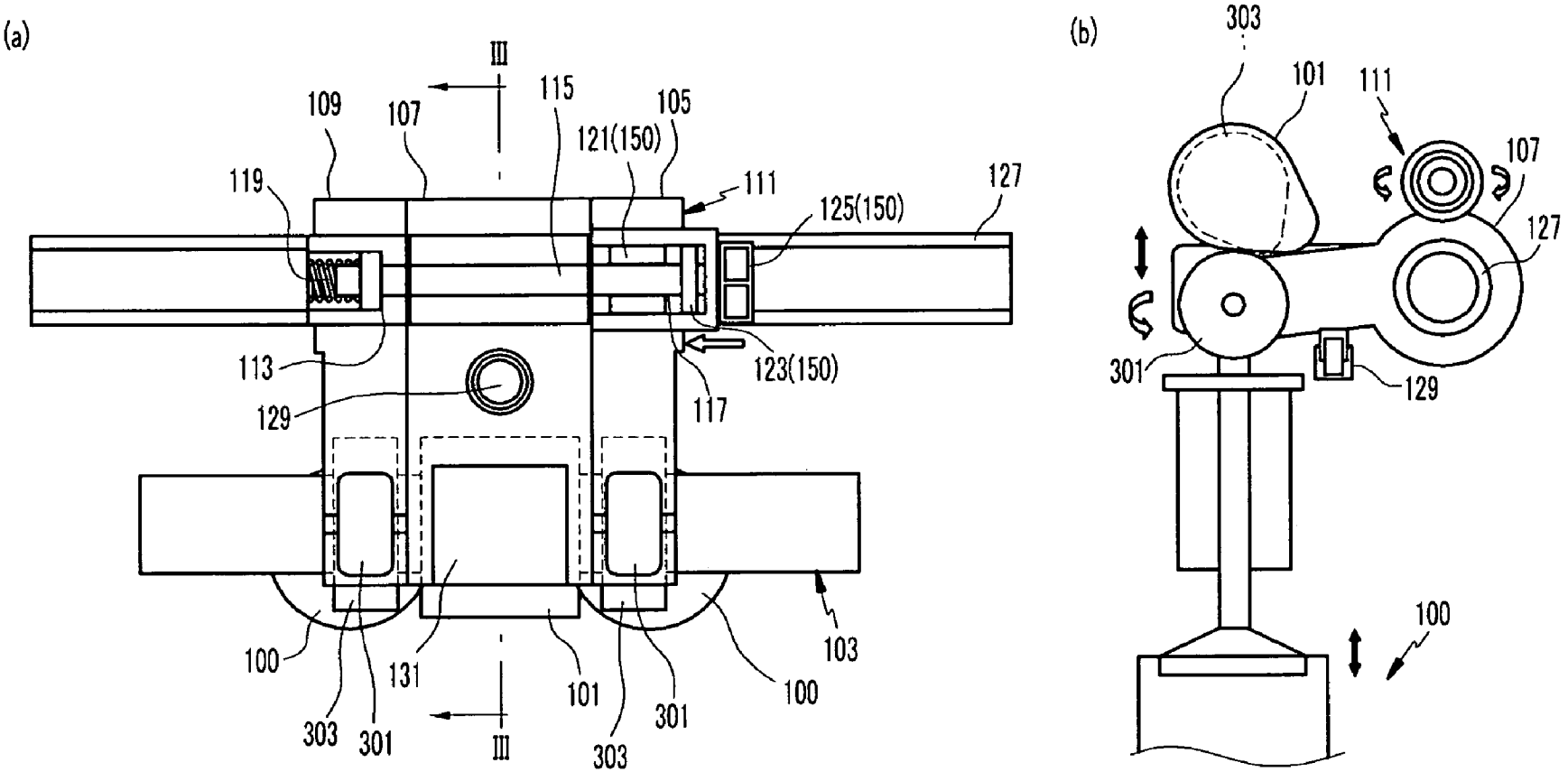
FIG. 3 shows a state in which a variable valve lift apparatus that is applied to a variable valve lift (VVL) system is off according to an exemplary embodiment of the present invention. More particularly, FIG. 3(*b*) is a sectional view along line III-III in FIG. 3(*a*).
Figure 4:
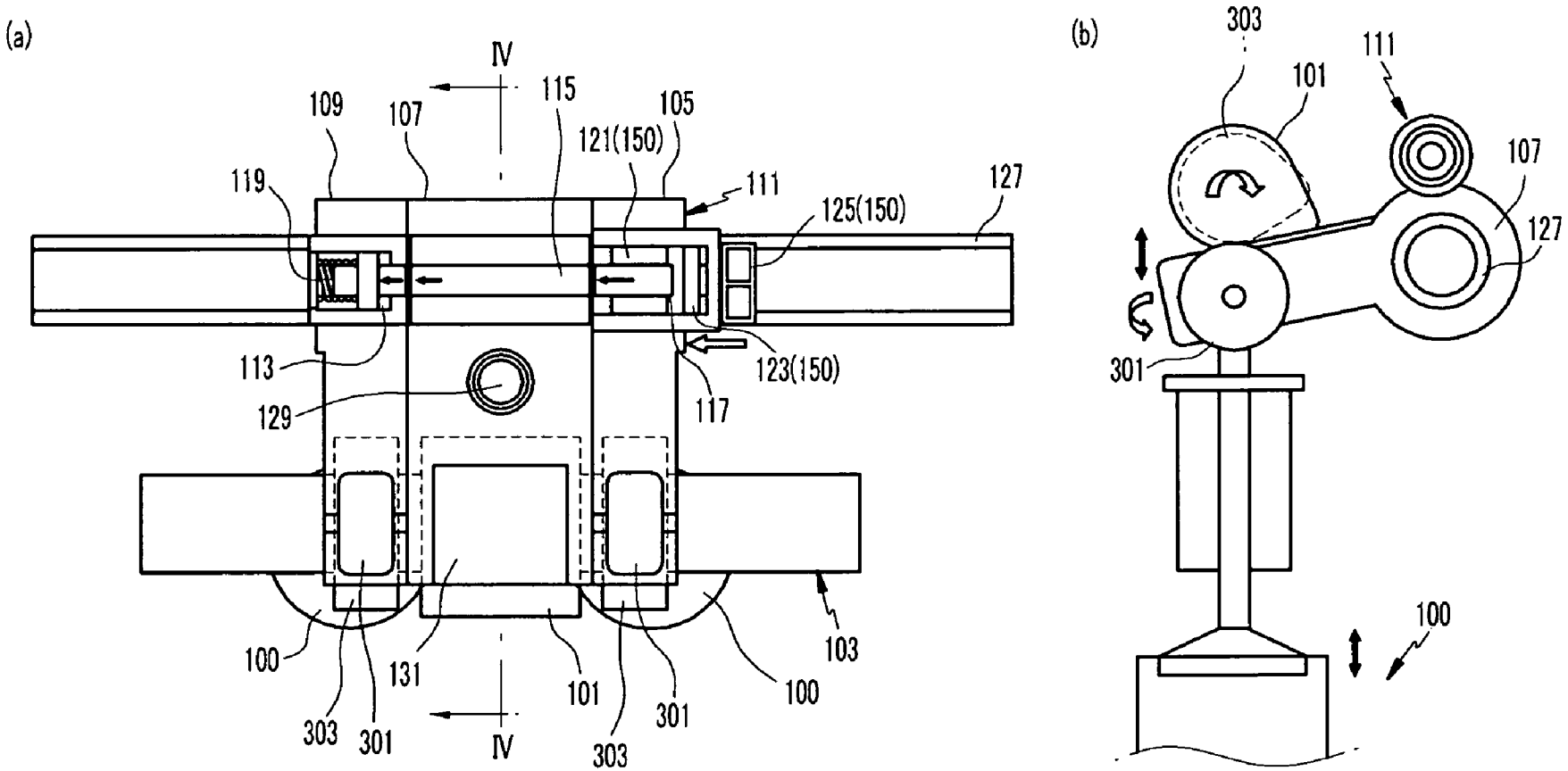
FIG. 4 shows a state in which a variable valve lift apparatus that is applied to a variable valve lift (VVL) system is on according to an exemplary embodiment of the present invention. More particularly, FIG. 4(*b*) is a sectional view along line IV-IV in FIG. 4(*a*).

Referring to FIG. 3 and FIG. 4, according to a second exemplary embodiment of the present invention, the variable valve lift apparatus is utilized for a variable valve lift (VVL) system. A VVL system regulates an opening/closing amount of the valve. The variable valve lift apparatus of the second exemplary embodiment is similar to that of the first exemplary embodiment, with the addition of an outer cam 303 and an outer needle bearing 301.

The outer cam 303 has a smaller radius than that of the cam 101 and is disposed on the valve 100, i.e., on the outer cam followers 105 and 109.

Referring to FIG. 3, when the variable device 111 does not operate, the cam followers 105, 107, and 109 move independently. In addition, referring to FIG. 4, when the variable device 111 operates, the outer cam followers 105 and 109 and the inner cam follower 107 move as a single unit.

Therefore, when the variable device 111 does not operate, the rotation of the cam 101 does not affect a movement of the outer cam followers 105 and 109, and the outer cam followers 105 and 109 move up and down by the outer cam 303.

Because the outer cam 303 has a smaller radius than that of the cam 101, the opening/closing amount of the valve 100 is reduced.

In addition, when the variable device 111 is operated, as shown in FIG. 4, the cam followers 105, 107, and 109 move together. Therefore, the opening/closing amount of the valve 100 increases.

According to an exemplary embodiment of the present invention, the variable valve lift apparatus has an increased operating area and a simple scheme because of not being operated by hydraulic pressure. In addition, because the apparatus does not utilize oil, operating performance is not deteriorated, and because additional sensors are not necessary, costs and a developing period may be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A variable valve lift apparatus, comprising:

a cam;

a camshaft connected to the cam to rotate the cam;

at least one cam follower selectively connected to an end lever such that the cam follower opens and closes a valve corresponding to rotation of the cam; and a variable device selectively connecting the at least one cam follower with the end lever to regulate whether or how much the valve is opened and closed;

wherein the cam follower comprises:

at least two outer cam followers fixedly connected to the end lever, and an inner cam follower interposed between and selectively connected to the outer cam followers corresponding to an operation of the variable device, wherein the variable device comprises:

a first pin located in a first one of the outer cam followers;

a second pin located in the inner cam follower; and a third pin located in a second one of the outer cam followers, wherein the pins are configured to move together, wherein the variable device further comprises:

an elastic member biasing the first pin toward the third pin; and a solenoid device operating such that the third pin moves toward the first pin, and wherein the solenoid device comprises:

a coil generating a magnetic force if current is applied thereto;

an armature secured to the third pin such that the third pin moves toward the first pin when the current is applied to the coil; and an actuator operating the coil.

* * * * *